US011885582B1

(12) United States Patent
Pogosyan

(10) Patent No.: US 11,885,582 B1
(45) Date of Patent: Jan. 30, 2024

(54) FIREARM SAFETY DEVICE

(71) Applicant: Areg Alex Pogosyan, Hicksville, NY (US)

(72) Inventor: Areg Alex Pogosyan, Hicksville, NY (US)

( * ) Notice: Subject to any disclaimer, the term of this patent is extended or adjusted under 35 U.S.C. 154(b) by 0 days.

(21) Appl. No.: 18/134,179

(22) Filed: Apr. 13, 2023

(51) Int. Cl.
*F41A 9/62* (2006.01)
*F41A 9/70* (2006.01)

(52) U.S. Cl.
CPC . *F41A 9/62* (2013.01); *F41A 9/70* (2013.01)

(58) Field of Classification Search
CPC ..... F41A 9/53; F41A 9/62; F41A 9/70; F41A 19/01
USPC ..... 42/1.01–1.05, 50
See application file for complete search history.

(56) References Cited

U.S. PATENT DOCUMENTS 3,024,453 A * 3/1962 Ransom ..... G01V 3/08 324/179
4,103,639 A * 8/1978 Otteson ..... F41A 9/53 116/272
4,494,329 A * 1/1985 Post ..... F41A 17/14 42/1.05
5,826,360 A * 10/1998 Herold ..... F41A 9/62 42/1.02
2006/0011187 A1* 1/2006 Gardner ..... F41B 11/62 124/73
2008/0039962 A1* 2/2008 McRae ..... G01S 17/88 356/3
2017/0370665 A1* 12/2017 Delgado Acarreta ..... F41A 9/53
2019/0277590 A1* 9/2019 Masarik ..... F41A 9/70
2021/0254916 A1* 8/2021 Czarnecki ..... F41A 19/01

FOREIGN PATENT DOCUMENTS

WO WO-2021001720 A1 * 1/2021 ..... F41A 9/62

* cited by examiner

*Primary Examiner* — Joshua E Freeman
*Assistant Examiner* — Benjamin S Gomberg
(74) *Attorney, Agent, or Firm* — Sterne, Kessler, Goldstein & Fox P.L.L.C.

(57) ABSTRACT

In a firearm, the ammunition magazine has an enhanced body, display, and circuitry to provide indication of the when there is ammunition loaded in the magazine or when there is no ammunition in the magazine. Additionally, or alternatively, the firearm has an enhanced body, display, and circuitry to provide indication of when there is ammunition in the chamber, when there is no ammunition in the chamber, or other warnings such as a malfunction or jam.

20 Claims, 8 Drawing Sheets

FIREARM SAFETY DEVICE

BACKGROUND

Personal firearms, including handguns and rifles, are inherently dangerous to both the users of those firearms and everyone and everything within range. Accordingly, firearm safety is of great concern to both gun owners and communities. Some dangers associated with firearms include inappropriate or accidental discharge, mismanagement of ammunition, misunderstanding regarding the loaded status of the weapon, or misunderstanding regarding the intent of the bearer of the firearm.

Due to these dangers, it is highly desirable to ensure that the user of the firearm, and those in proximity to the firearm, are aware of the status and the danger associated with the weapon. Language barriers, ambient noise, human error, fear, or confusion can inhibit the ability of gun owners and bystanders to communicate or understand the danger posed by a specific weapon. Accidental discharge or other misapprehension of the status of a firearm is a major cause of firearm-related injury and death.

Despite gun safety laws, best practices, and training, gun-related violence remains a widespread societal concern and cause of preventable death and injury. There remains a need in the art to provide more effective physical controls on gun operation, as well as universally understandable indicia of the danger posed by a specific firearm, including the presence of ammunition in the magazine and/or chamber. The current invention provides visual feedback to the user of the firearm, as well as surrounding bystanders, communicating the status and location of ammunition.

SUMMARY

This disclosure describes a device and associated uses and methods of manufacture for providing a visual indicator of ammunition in the magazine or chamber of a firearm. In one embodiment, an ammunition magazine for a firearm is provided that has a mechanism to detect the presence of ammunition loaded in a magazine and to indicate to the user the loaded status of the magazine through an LED visible to the user or nearby individuals. Other types of displays may similarly indicate the "loaded" status of a firearm when ammunition is detected in the magazine.

For example, a display may be provided on the magazine itself which indicates whether there is one or more rounds located in the magazine. The display is illuminated if one or more rounds are present. The display is dark or unilluminated if no round is present. The illumination of the display, such as an LED, is effective to notify the user and other persons in proximity to the user regarding the loaded status of each and every magazine in the area. The display also allows for quick and easy indication to law enforcement, police authorities, and service members if the holder of the weapon (whether a suspected hostile individual, fellow law enforcement, or themselves) have a properly loaded firearm at their disposal in a quick manner.

In another embodiment, the display may indicate the presence of ammunition in the chamber of a firearm. This display may be a different display than the display indicating the presence of ammunition in the magazine. This display may indicate the presence of properly loaded cartridge that is ready to fire. Alternatively, a display may indicate malfunction with a weapon, including an incomplete discharge or jam of ammunition in the chamber. A display may indicate such different possibilities through different colors, steady or flashing illuminations, and/or other visual, auditory, or tactile feedback.

In another embodiment, a smart cylinder may be placed into the weapon barrel to detect the presence of a bullet within the weapon barrel.

DETAILED DESCRIPTION OF EMBODIMENTS

Figure 1:
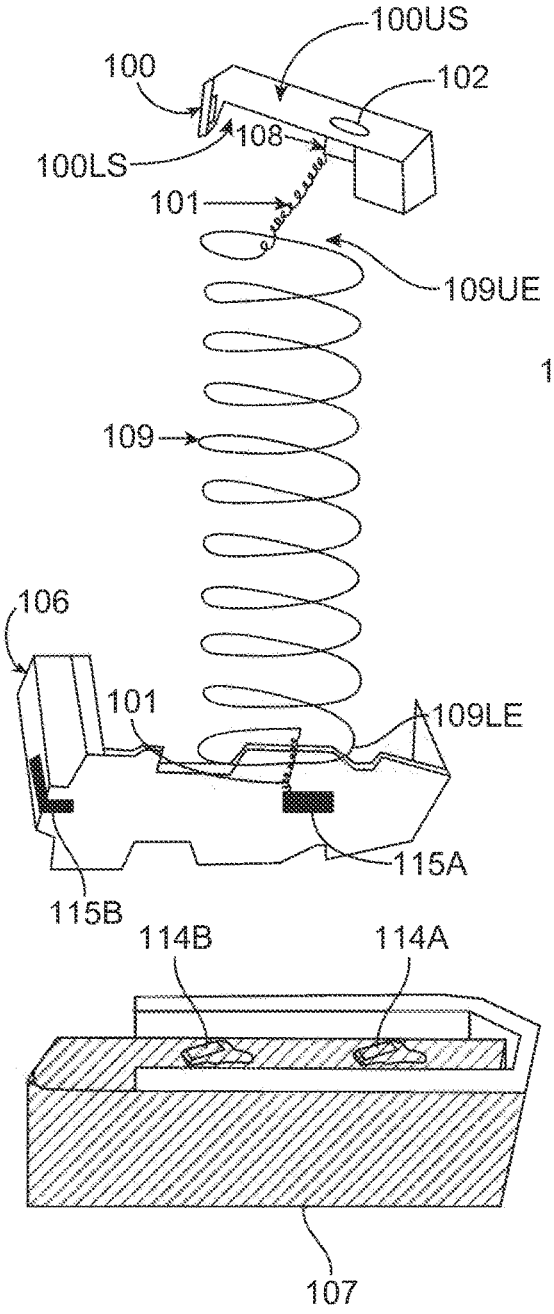
FIG. 1 shows an exploded view of the internal mechanism of a firearm ammunition magazine according to one embodiment of the present disclosure.
Figure 2A:
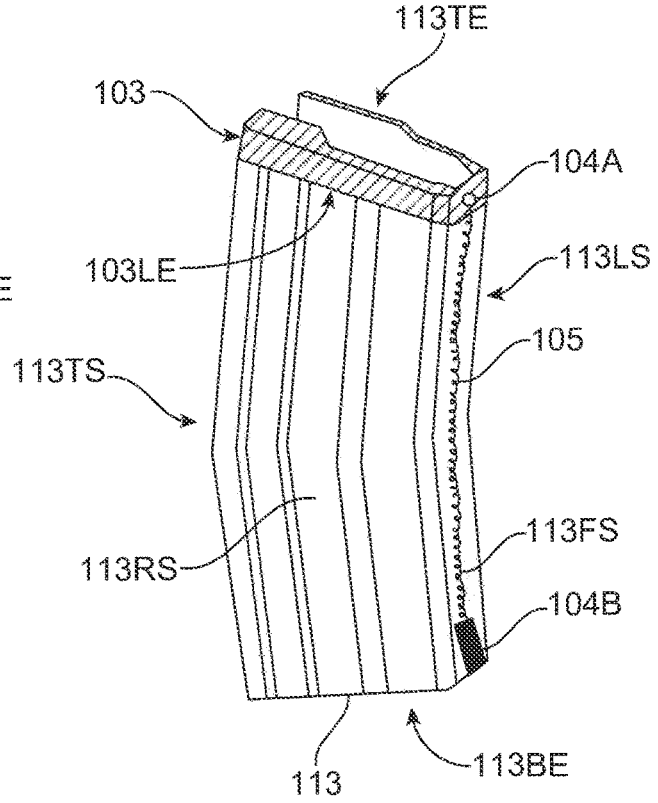
FIG. 2A shows a view of the external structure of a firearm ammunition magazine according to one embodiment of the present disclosure.
Figure 2B:
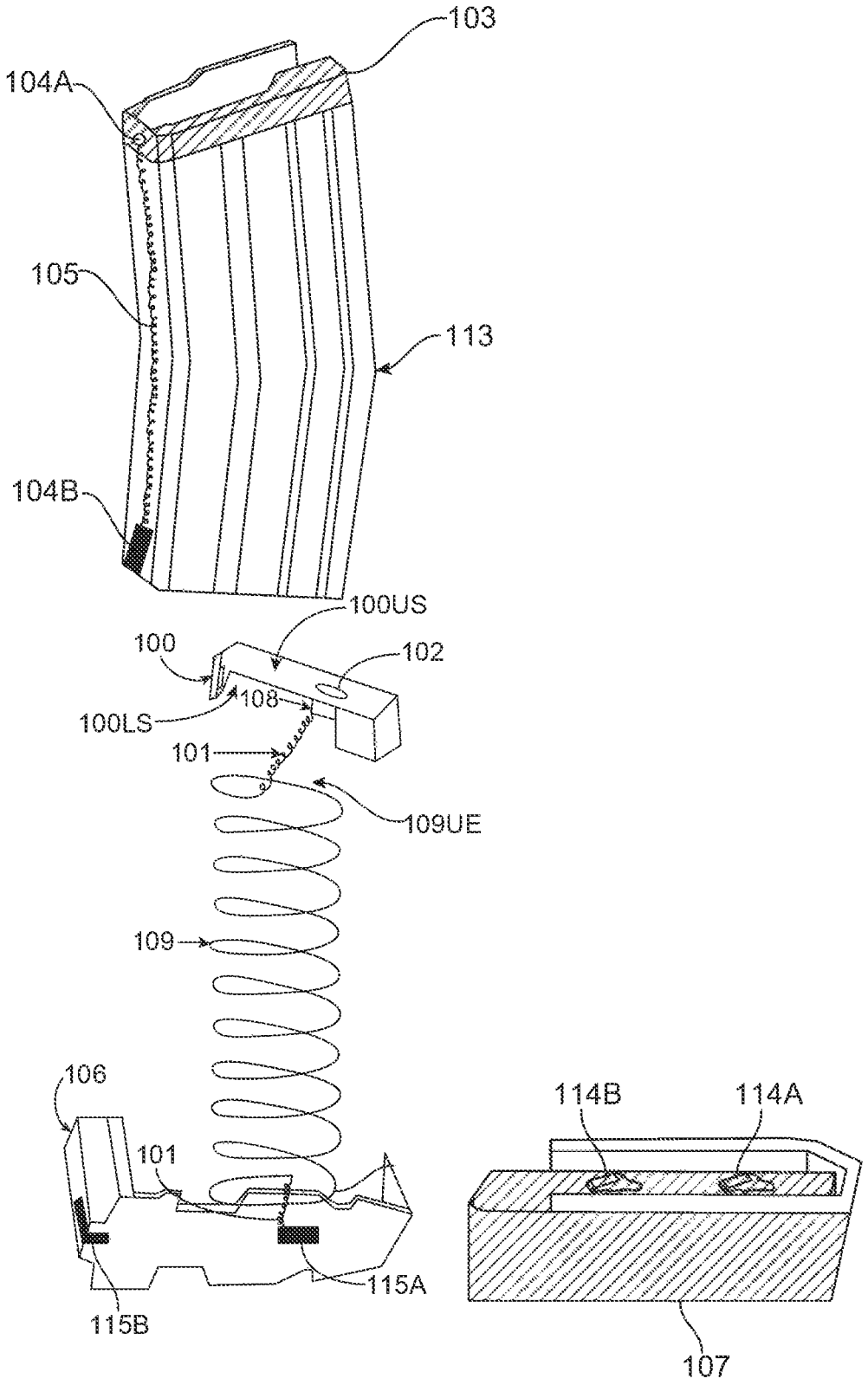
FIG. 2B shows an exploded view of the magazine body, feed lip and spring interaction.
Figure 3:
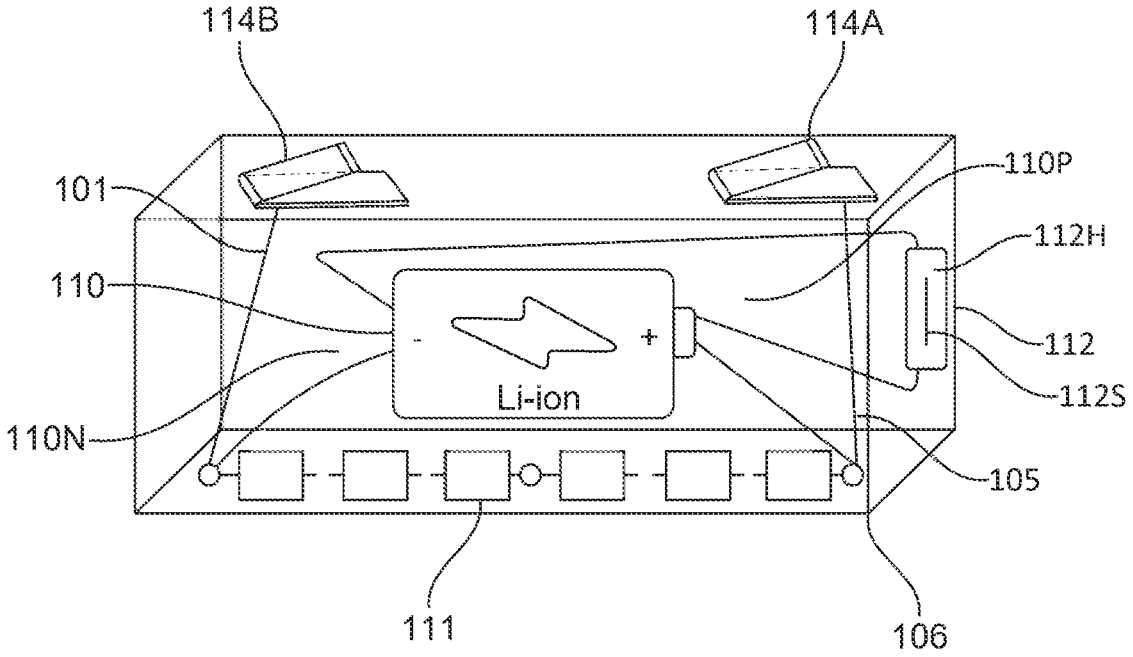
FIG. 3 shows a detailed view of the enhanced floor plate of a firearm ammunition magazine according to one embodiment of the present disclosure.
Figure 4:
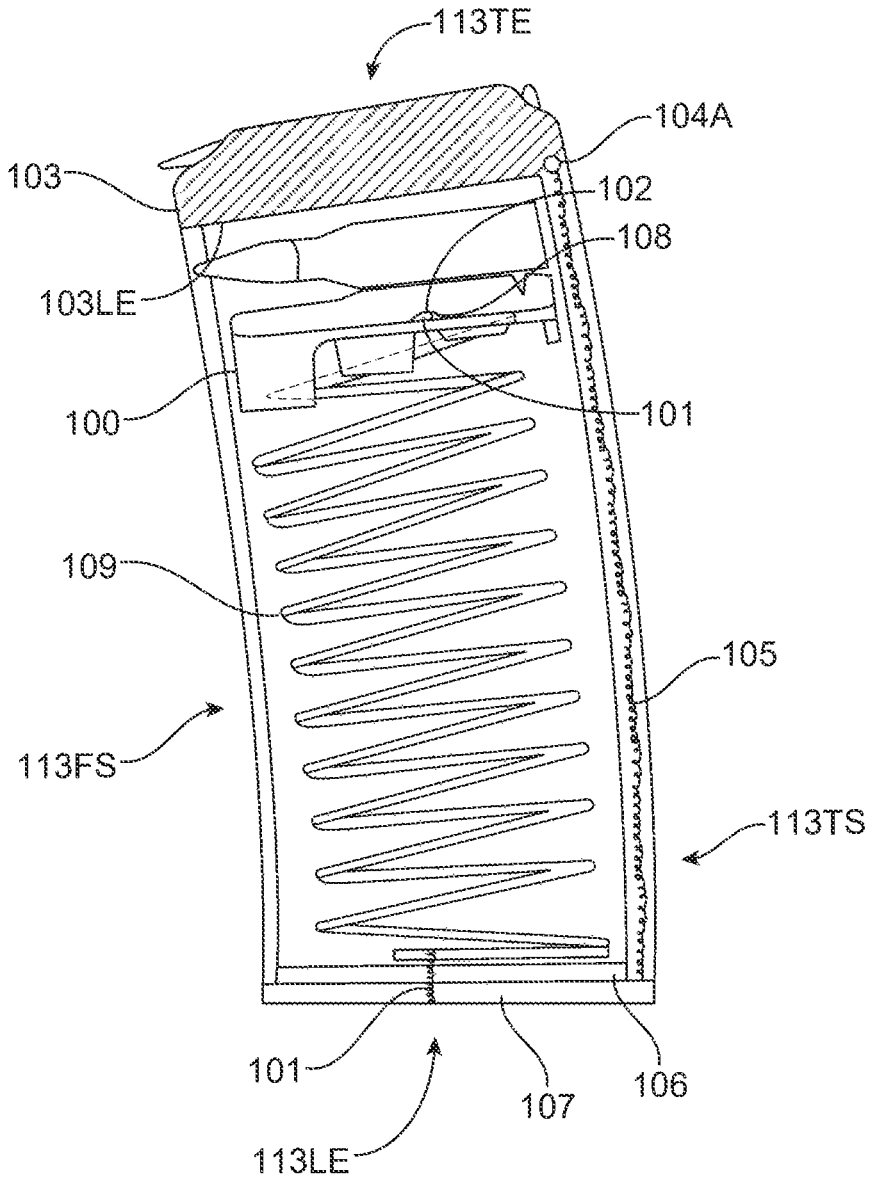
FIG. 4 shows a cross-sectional view of a firearm ammunition magazine according to one embodiment of the present disclosure.

The disclosure herein provides a weapons magazine having a means to indicate the status of the ammunition rounds within the magazine. The magazine has a body 113 which consists of a left side 113LS, a right side 113RS, a front side 113FS and a trailing side 113TS a top end 113TE and a bottom end 113BE. An enhanced feed lip 103 is attached to the top end 113TE of the magazine body 113. The enhanced feed lip 103 has a lower edge 103LE which is disposed internally to the body 113 when the feed lip 103 is attached to the body 113. The floor plate retainer 106 is secured within the bottom of the spring 109. The enhanced floor plate 107 locks the floor plate retainer in place at the bottom end 113BE of the body 113. Modifications to the magazine body and internal apparatus may be made to adjust for any caliber ammunition and firearm.

The floor plate retainer 106 is held in position inside the body 113 because of the enhanced floor plate 107. The floor plate retainer has an upper surface 106US and a lower surface 106LS. A spring 109 for is disposed internally to the body 113. The spring is generally helical in configuration and has a lower end 109LE and an upper end 109UE. The spring 109 is operative to bias the follower 100 up and away from the floor plate retainer 106 in order to position a bullet proximate the chamber of the firearm when the magazine body 113 is inserted in place to the firearm. The lower end 109LE of the spring 109 is attached to the upper surface 106US of the floor plate retainer 106. The spring 109 extends within the magazine body 113 upward from the floor plate retainer 106. A follower 100 is disposed internal to the magazine body 113. The follower 100 has a lower surface 100LS and an upper surface 100US. The lower surface 100LS of the follower 100 attached to the upper end 109UE of the spring 109. The upper surface 100US follower 100 is configured to allow one or more loaded bullets to rest thereon.

The enhanced floor plate 107 contains circuitry for indicating the status regarding presence of one or more bullets within the magazine. There is a power source 110 within the enhanced floor plate. The power source 110 may be a rechargeable Li-Ion battery. The power source has a positive terminal 110P and a negative terminal 110N. An illumination source 111 is connected in series between the positive and negative terminal of the power source 110. The illumination source 111 may be a plurality of LED's connected in series. The power source charging circuit 112 is connected to the power source 110 in series with the illumination source 111. There is a power source charger "socket" (112S that is disposed in an hole (112H in the enhanced floor plate 107, allowing connection to a remote power source (not shown) in order to recharge the power source 110. A positive conductor 105 is connected to the positive terminal 110P of the power source 110. A negative conductor 101 is connected to the negative terminal 110N of the power source 110. The positive conductor 105 and negative conductor 101 pass through appropriate openings (not shown) in the enhanced floor plate 107.

Spring finger battery negative contact 114B and spring finger battery positive contact 114A are positioned on the enhanced floor plate upper surface 107U. The spring finger battery negative contact 114B is connected to the negative conductor 101. The spring finger battery positive contact 115A is connected to the positive conductor 105.

A metal contact 104A is positioned in the enhanced feed lip 103. The contact 104A can be a rivet, metallic tape, or other metal that can be anchored to the body and provide electrical connection. The positive conductor 105 is electrically connected to the metal contact 104A, and a second metal contact 104B, preferably by soldering. The second metal contact 104B may also be a rivet, metallic tape, or other metal that can be anchored to the body and provide electrical connection. A sensor 108 is placed in the follower 100. An extension of the negative conductor 101 connects the spring 109 to the sensor 108. There is an opening 102 in the follower to allow for positioning of the sensor 108 such that the sensor 108 can sense/detect when there is no bullet left in the magazine body 113. The sensor may be a direct contact between the metal contact 104A and sensor 108. Alternately the sensor may be an infrared sensor, a step switch, lever switch, magnetic switch, a physical button or another known actuator. In other embodiments, the sensor may be placed in alternate locations allowing for manufacture preferences.

In one embodiment, the magazine body 113 is formed of a non-conductive material. The spring 109 is formed of an electronically conductive material. The negative conductor 101 is connected between the negative terminal 110N of the power source 110 and the lower end 109LE of the spring 109. The spring is in turn connected to the sensor 108 positioned in the follower 100. The positive conductor 105 is connected between the positive terminal 110P of the power source 110 and the metal contact 104A on the enhanced feed lip 103 by contact between 115A and 114A respectively. The positive conductor 105 is placed external to the magazine body 113. The positive conductor may be alternately placed internal to the magazine body 113 in a manner such that the conductor does not interfere with the free motion of the spring 109, the follower 100 or any loaded bullets.

In such a preferred embodiment, when one or more bullets are loaded in the body 113, the sensor 108 senses, detects or contacts the metal contact 104A on the enhanced feed lip 103. When the sensor 108 detects or contacts the metal contact 104A, the sensing/detection circuit is "closed" and as such the illumination source 111 is turned on and illuminated indicating the presence of at least one bullet within the magazine.

When there are no bullets in the body 113, the sensor 108 does not sense, detect or contact with the metal contact 104A on the enhanced feed lip 103. When the sensor 108 does not sense or detect or is not in contact with the metal contact 104A in the enhanced feed lip 103, the sensing/detection circuit is "open" and as such the illumination source 111 is turned off. The illumination source being turned off indicates that there are no bullets left in the magazine body 113.

It is noted that the spring 109 itself may be extended to be in direct contact with the sensor 108 in the follower 110. It is noted that the spring 109 itself may be extended to be in direct contact with the negative terminal 110N of the power source 110 in lieu of the negative conductor 101.

In another embodiment, the magazine body 113 is conductive and the spring 109 and follower 100 are insulated from accidental contact with a conductive magazine body 113. The positive terminal 110N of the power source 110 is connected to the conductive magazine body 113 via positive conductor 105. The spring 109 and follower 100 provide the negative connection to the power source 110. As is the case with the preferred embodiment, the illumination source 111 will stay lit when there are one or more bullets inserted in the magazine body 113 and the illumination source 111 will turn off when there is no bullet inserted in the magazine body 113.

In yet another alternate embodiment, it is envisioned that the illumination source may be a numeric counter reflecting the exact number of bullets that are inserted in the magazine body.

Figure 5:
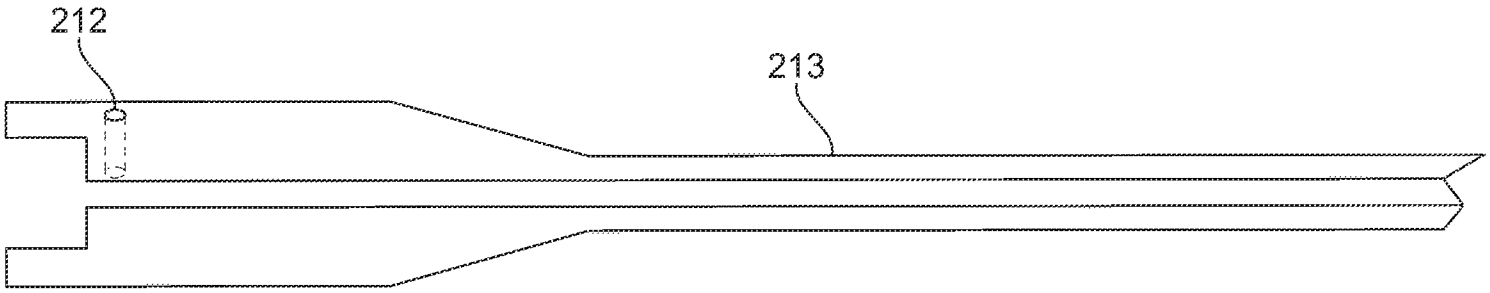
FIG. 5 shows a weapon barrel with a placement of the smart cylinder.

In yet an alternate embodiment, the smart sensor may be located in the weapon barrel. As seen in FIG. 5, there is a smart cylinder 212 is inserted into an opening in the weapon barrel 213.

Figure 6:
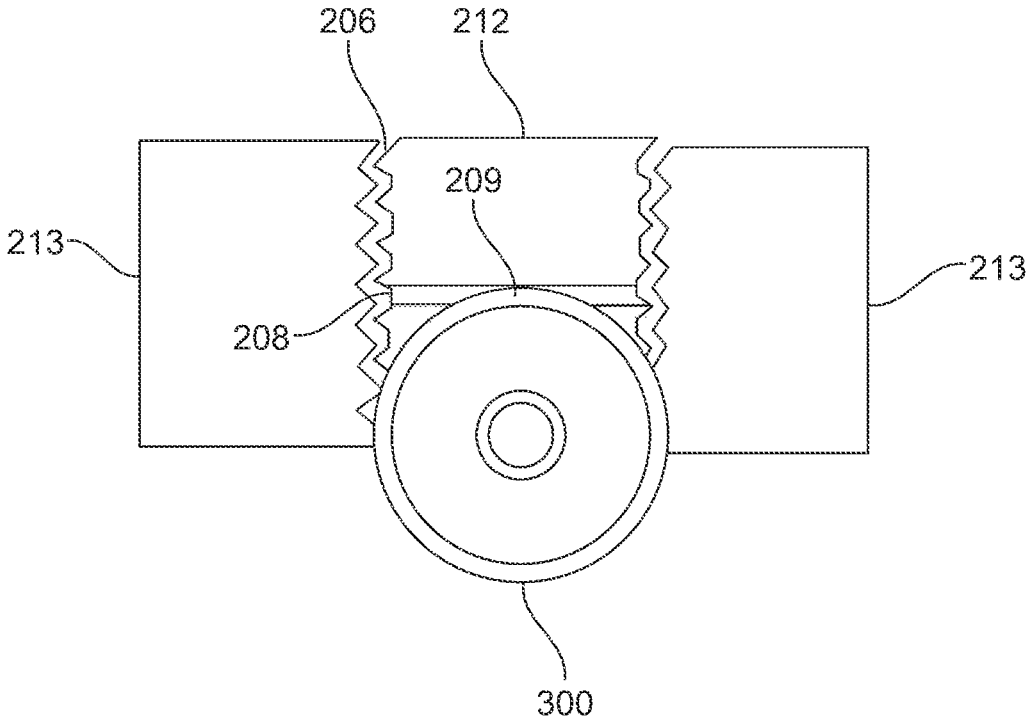
FIG. 6 shows a perspective cross section of a smart cylinder installed in a weapon barrel.

FIG. 6 shows a cross sectional view looking down the longitudinal axis of the weapon barrel. The smart cylinder 212 is inserted into the opening in the weapon barrel wall 213 by means of threads 206. Sensor 208 is positioned on the end of the smart cylinder 212 that is interior to the barrel. A curved surface 209 of the smart cylinder 212 is positioned nearest the center of the longitudinal axis of the barrel. The curved surface 209 is designed to match the circumferential geometry of a bullet 300 within the weapon barrel.

Figure 7:
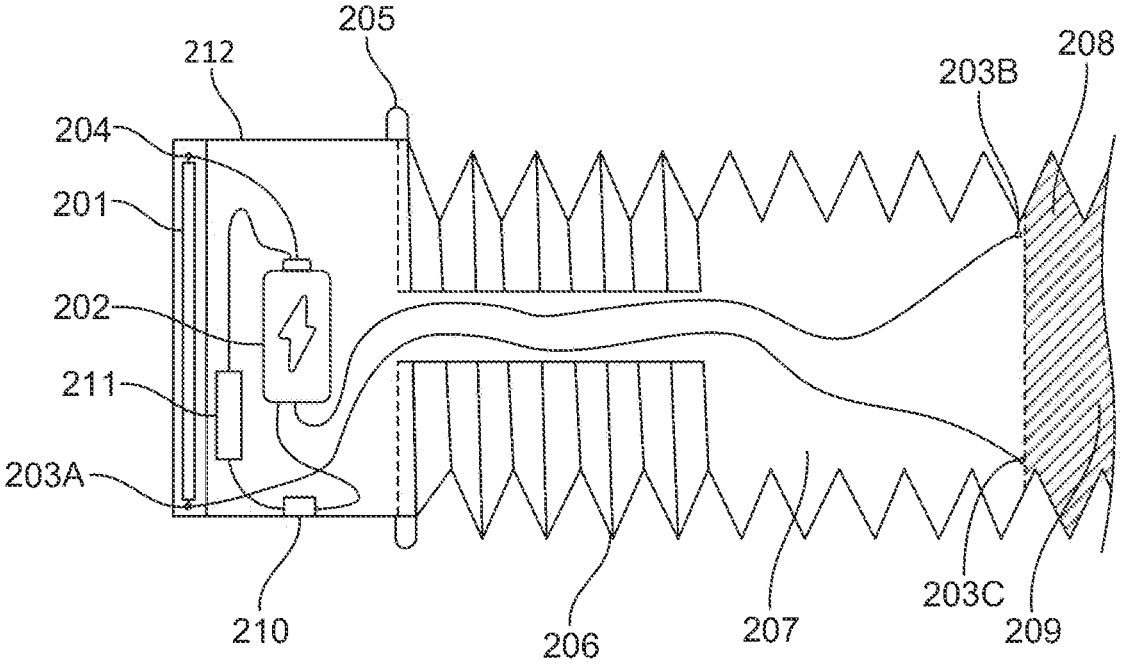
FIG. 7 shows an alternate perspective cross section of a smart cylinder.

FIG. 7 shows an exploded view of the smart cylinder 212. The smart cylinder 212 has threads 206 around approximately 75% of the length of the smart cylinder 212 allowing the smart cylinder to be screwed into corresponding threads the weapon barrel 213. The threads 206 also allow for easy removal of the smart cylinder 212 from the weapon barrel 213 in order to clean the weapon's components.

Also shown in FIG. 7, there is a gasket 205 around the smart cylinder 212 body to ensure that gasses do not enter the smart cylinder 212 electronic components. There is also a small failsafe space 207 located proximate the curved surface 208 of the smart cylinder. This failsafe space 207 is designed to diminish the pressures created when the bullet 300 is ignited, helping to ensure that the smart cylinder 212 is not ejected from the corresponding opening in the weapon barrel when the weapon is fired. The failsafe space 207 is designed to absorb the impact of pressure when firing the weapon in order to avoid damage to the weapon barrel. Alternately, a spring (not shown) can be placed in the failsafe space 207 to help absorb the pressures.

Electronic elements of the weapon status indicator are also shown in FIG. 7. A battery 202 is located in the smart cylinder 212. An illumination source 201 is located on the end of the smart cylinder 212 that is exposed external the weapon barrel 213 when the smart cylinder is inserted into the weapon barrel 213. The illumination source 201 is preferably a LED. There is a charging port 210 exposed on a side of the housing of smart cylinder 212. Internal to the smart cylinder 212, charging port electronics 211 are connected via lead wires between the charging port 210 and the positive terminal of battery 202. The charging port 210 is also connected to the negative terminal of the battery 202.

Also shown in FIG. 7, the positive terminal of the battery 202 is also connected via wire to the positive terminal 204 of the illumination source 201. The negative terminal 203A of the illumination source 201 is connected via a wire running through the smart cylinder 212 to sensor contact 203C at the flat surface of 208 of the smart cylinder 212. Another sensor contact 203B is also located at the flat surface of 208 of the smart cylinder 212. Sensor 203B is connected via a wire running through the smart cylinder 212 to the negative terminal of the battery 202. When a bullet is sensed in the curved surface 209 of the smart cylinder 212, the electronics circuit is closed, causing the illumination source 201 to illuminate indicating the presence of a bullet within the weapon barrel 213.

Figure 8:
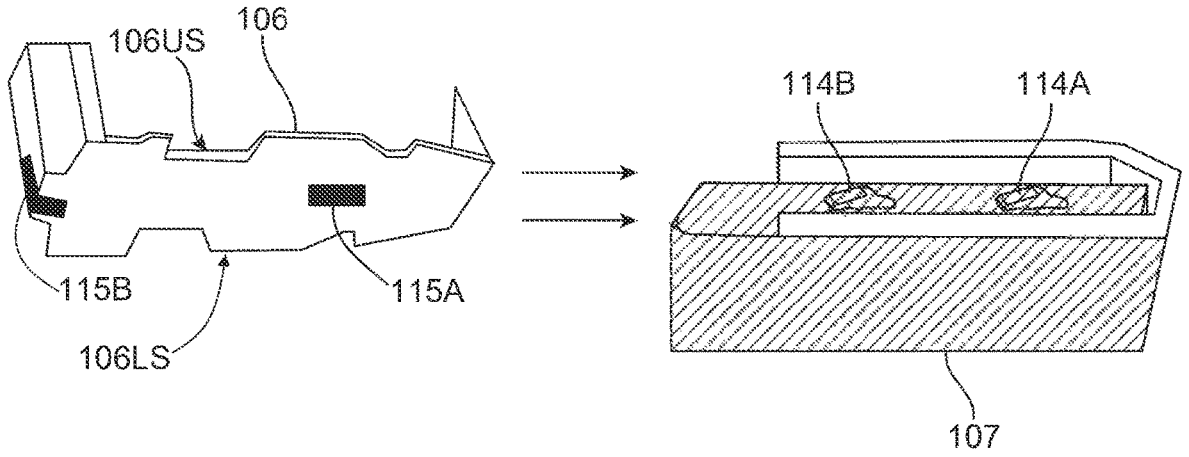
FIG. 8 shows a perspective of how the floor plate retainer and enhanced floor plate are slid into position when being connected.

Referring to FIG. 8, the enhanced floor plate 107 and floor plate retainer 106 are slid into relative position as shown by the arrows. When the floor plate 107 and floor plate retainer 106 are fully connected, floor plate retainer negative contact 115B and spring finger battery negative contact 114B are in operable connection with each other. Likewise, when floor plate 107 and floor plate retainer 106 are fully connected, floor plate retainer positive contact 115A and spring finger battery positive contact 114A are in operable connection with each other.

What is claimed is:

1. A firearm safety device comprising:

a magazine body made of non-conductive material;

a floor plate retainer located internally at a bottom end of the magazine body, wherein the floor plate retainer is locked into position by an enhanced floor plate configured to attach to the bottom end of the magazine body;

a sensor operably positioned in a follower configured to support one or more rounds of ammunition loaded in the magazine body, wherein the sensor is configured to close an analog circuit upon detecting the presence of the one or more rounds of ammunition in the magazine body; and a display device coupled to a rechargeable power source in the enhanced floor plate, wherein the display device is configured to provide feedback indicating the presence of the one or more rounds of ammunition in the magazine body when the analog circuit is closed.

2. The firearm safety device of claim 1, further comprising a metal contact located in an enhanced feed lip of the magazine body.

3. The firearm safety device of claim 2, wherein the sensor closes the analog circuit between the sensor and the metal contact when the one or more rounds of ammunition are loaded in the magazine body.

4. The firearm safety device of claim 1, wherein when the floor plate retainer is locked into position by the enhanced floor plate, a positive contact and a negative contact in the floor plate retainer are operably connected to a spring finger battery positive contact and a spring finger battery negative contact in the enhanced floor plate.

5. The firearm safety device of claim 4, further comprising:

a spring made of a conductive material connected between the follower and the floor plate retainer, wherein the spring is configured to bias the follower away from the floor plate retainer and electrically connect the rechargeable power source and the sensor.

6. The firearm safety device of claim 1, wherein the feedback comprises one or more of: visual feedback, auditory feedback, or tactile feedback.

7. The firearm safety device of claim 1, wherein the rechargeable power source further comprises a rechargeable lithium-ion (Li-ion) battery and a charging port configured to connect to a remote power source.

8. The firearm safety device of claim 1, wherein the analog circuit does not include a microprocessor, microcontroller, or an integrated circuit.

9. A weapon device comprising:

a smart cylinder, wherein the smart cylinder is inserted into an opening of a weapon barrel;

a concave curved surface at a bottom end of the smart cylinder, wherein the concave curved surface corresponds to an inner cylindrical surface of the weapon barrel;

a sensor configured to close an analog circuit upon detecting a round of ammunition in the weapon barrel; and a display device at a top end of the smart cylinder and viewable externally of the smart cylinder, wherein the display device is coupled to a rechargeable power source in the smart cylinder and configured to provide feedback indicating the presence of the round of ammunition in the weapon barrel when the analog circuit is closed.

10. The weapon device of claim 9, further comprising:

wherein the rechargeable power source further comprises a rechargeable lithium-ion (Li-ion) battery and a charging port configured to connect to a remote power source.

11. The weapon device of claim 9, further comprising: a first sensor contact and a second sensor contact located at a flat surface of the sensor, such that the sensor closes the analog circuit between the first sensor contact and the second sensor contact when the round of ammunition is sensed in the weapon barrel.

12. The weapon device of claim 9, further comprising:

threads within a interior wall of the opening in the weapon barrel for receiving the smart cylinder;

threads surrounding a exterior wall of the smart cylinder, wherein the threads within the interior wall of the opening in the weapon barrel engage the threads surrounding the exterior wall of the smart cylinder in a manner in which the smart cylinder screws into the opening in the weapon barrel.

13. The weapon device of claim 9, further comprising:

a failsafe space located proximate to the concave curved surface, wherein the failsafe space is configured to absorb impact of pressure when firing the round of ammunition; and a gasket around the smart cylinder, wherein the gasket is configured to prevent gasses from entering electronic components of the smart cylinder.

14. A firearm comprising:

a magazine body made of non-conductive material;

a floor plate retainer located internally at a bottom end of the magazine body, wherein the floor plate retainer is locked into position by an enhanced floor plate configured to attach to the bottom end of the magazine body;

a first sensor operably positioned in a follower configured to support one or more rounds of ammunition loaded in the magazine body, wherein the first sensor is configured to close a first analog circuit upon detecting the one or more rounds of the ammunition in the magazine body;

a first display device coupled to a rechargeable power source in the enhanced floor plate, wherein the first display device is configured to provide feedback indicating the presence of the one or more rounds of ammunition in the magazine body when the first analog circuit is closed; and a smart cylinder inserted in an opening of a barrel of the firearm and configured to detect one round of ammunition in the barrel of the firearm.

15. The firearm of claim 14, wherein the first sensor closes the first analog circuit between the first sensor and a metal contact in an enhanced feed lip of the magazine body when the one or more rounds of ammunition are loaded in the magazine body.

16. The firearm of claim 15, wherein the smart cylinder further comprises:

a concave curved surface at a bottom end of the smart cylinder, wherein the concave curved surface corresponds to an inner cylindrical surface of the barrel of the firearm;

a second sensor configured to close a second analog circuit upon detecting the one round of ammunition in the barrel of the firearm; and a second display device at a top end of the smart cylinder and viewable externally of the smart cylinder, wherein the second display device is coupled to a rechargeable power source in the smart cylinder and configured to provide visual feedback indicating the presence of the one round of ammunition in the barrel of the firearm when the second analog circuit is closed.

17. The firearm of claim 16, wherein the second sensor further comprises: a first sensor contact and a second sensor contact located at a flat surface of the second sensor, such that the second sensor closes the second analog circuit between the first sensor contact and the second sensor contact when the one round of ammunition is sensed in the barrel of the firearm.

18. The firearm of claim 16, wherein the smart cylinder further comprises:

a failsafe space located proximate to the concave curved surface, wherein the failsafe space is configured to absorb impact of pressure when firing the one round of ammunition; and a gasket around the smart cylinder, wherein the gasket is configured to prevent gasses from entering electronic components of the smart cylinder.

19. The firearm of claim 14, wherein the feedback provided by the first display device comprises one or more of: visual feedback, auditory feedback, or tactile feedback.

20. The firearm of claim 14, wherein the smart cylinder further comprises:

threads within an interior wall of the opening in the barrel for receiving the smart cylinder;

threads surrounding an exterior wall of the smart cylinder; and wherein the threads within the interior wall of the opening in the barrel engage the threads surrounding the exterior wall of the smart cylinder in a manner in which the smart cylinder screws into the opening in the barrel.

* * * * *